United States Patent [19]

Park

[11] Patent Number: 4,573,293

[45] Date of Patent: Mar. 4, 1986

[54] BUILDING STRUCTURE

[75] Inventor: Owen H. Park, Carmel, Ind.

[73] Assignee: Heartland Industries, Inc., Carmel, Ind.

[21] Appl. No.: 573,117

[22] Filed: Jan. 23, 1984

Related U.S. Application Data

[63] Continuation-in-part of Ser. No. 354,511, Mar. 3, 1982, Pat. No. 4,481,744.

[51] Int. Cl.[4] ..... E04D 11/02

[52] U.S. Cl. ..... 52/92; 52/94

[58] Field of Search ..... 52/92, 90, 94, 93

[56] References Cited

U.S. PATENT DOCUMENTS

| | | | |
|---|---|---|---|
| 611,309 | 9/1898 | Young | 52/92 |
| 2,896,273 | 7/1959 | Petter | 52/94 |
| 3,293,808 | 12/1966 | Duncan | 52/94 |
| 4,409,763 | 10/1983 | Rydeen | 52/93 |

FOREIGN PATENT DOCUMENTS

| | | | |
|---|---|---|---|
| 660033 | 7/1929 | France | 52/90 |

*Primary Examiner*—John E. Murtagh

*Attorney, Agent, or Firm*—Barnes & Thornburg

[57] ABSTRACT

A building structure includes outer walls, a roof including a lower border that overhangs at least one of the outer walls, and a frame for supporting the outer walls and roof. The frame includes a frame member forming part of an upper portion of the one outer wall. The frame member has a top edge adjacent the roof and a bottom edge. A wall panel is secured to the frame adjacent the bottom edge of the frame member, such that the panel forms the lower portion of the one outer wall. The structure also includes at least one spacer member supported on the top edge of the frame member. The spacer member has a side surface that forms the upper portion of the frame and a top surface at an acute angle with respect to the side surface that supports a roof member to provide the lower border of the roof. The building structure also includes a shelf member positioned between the top edge of the frame member and the bottom surface of the at least one spacer member.

13 Claims, 9 Drawing Figures

BUILDING STRUCTURE

This invention is a continuation-in-part of my copending U.S. patent application Ser. No. 354,511 filed March 3, 1982 now U.S. Pat. No. 4,481,744.

The present invention relates to building structures, and more particularly to improvements which strengthen and straighten the framework, reduce waste of building materials, and provide design flexibility.

Three problems typically associated with building construction are efficient utilization of building materials to reduce waste, efficient utilization of structure to provide maximum strength using minimum structure, and structural design which facilitates its replacement. Efficient utilization of building materials and structure reduces the overall cost of the building. Buildings having structure which facilitates replacement of various components are more attractive to the potential buyer. Various structural improvements in buildings have heretofore been proposed for solving one or more of the aforementioned problems. However, most structural improvements do not address all three of these problems.

It is one object of the present invention to provide a building structure which reduces building material waste, strengthens and straightens the structure of the building, and facilitates removal and replacement of a component of the building.

Another object of the present invention is to provide a building structure which increases design flexibility.

It is yet another object of the invention to provide a sidewall construction that permits the utilization of conventional 4 foot ×4 foot wood panels without any type of modification and which permits the construction of an overall taller building using only conventional building materials.

These and other objects are achieved in a building which includes outer walls, a roof having a lower border that overhangs one or more of the outer walls, a frame for supporting the outer walls and roof, and a roof support member for supporting the overhanging roof border. The structure embodying the present invention includes a frame member forming an upper portion of the outer wall beneath the overhanging roof border and a wall panel forming a lower portion of the outer wall. The frame member has a top edge adjacent the roof. At least one spacer member is mounted on the top edge of the frame member. The spacer member is generally right triangular shaped. The spacer member has a first side generally parallel to the outer wall, a second side generally perpendicular to the outer wall, and a third side at an acute angle to the outer wall. The overhanging roof border engages the third side of the spacer member and is attached thereto. A soffit is interposed between the frame member and the spacer member. The frame member also has a bottom edge which includes a rabbet for receiving the wall panel. In the preferred embodiment, the frame member has a width, and the spacer member has a height, which are sufficient to allow construction of a building having an outer wall that is $4\frac{1}{2}$ feet high and an inner wall that is approximately 5 feet high utilizing a wall panel that is 4 feet high. Further, a building can be constructed having an outer wall that is $8\frac{1}{2}$ feet high and an inner wall that is approximately 9 feet high utilizing a wall panel that is 8 feet high. Thus, a sheet of building material that is 8 feet in length can be used to provide wall panels for both buildings without any waste. Further, the interior height of the building is increased without adding to the overall height of the building.

In the illustrative embodiment, the frame member is secured transverse to the frame studs of the building structure, thereby to increase the strength of the building structure and increase the stiffness of the frame studs.

The top edge of the frame member is cut to form a top edge surface that is perpendicular to an inner surface of the frame member. Cutting the top edge of the frame member in this manner presents a flat surface upon which the spacer member and the soffit or shelf member may be secured to the top edge of the frame member.

Various features and advantages of the present invention will become apparent in view of the following detailed description of one embodiment thereof exemplifying the best mode of carrying out the invention as presently perceived, which embodiment should be considered in conjunction with the accompanying drawings, in which.

Figure 1:
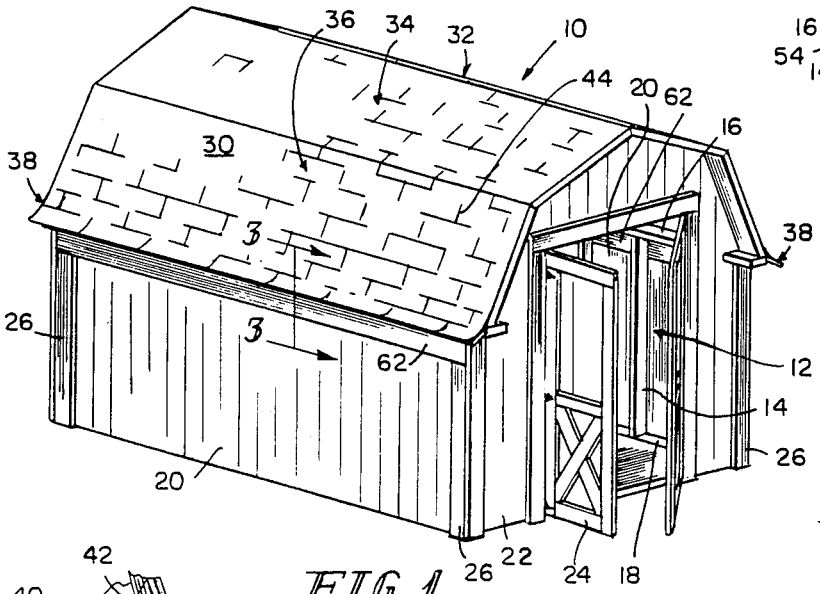
FIG. 1 is a perspective view of a building structure embodying the present invention.

Referring now to FIG. 1, a building structure 10 embodying the present invention comprises a frame 12 which includes a plurality of vertical studs 14 and horizontal top and bottom plates 16 and 18, respectively, supporting the studs 14 in spaced-apart vertical relationship. Outer side wall panels 20 and outer end wall panels 22 are secured to the frame 12 using nails or other conventional means, and a roof 30 is mounted on the frame 12 to enclose the structure. A door 24 is provided in one of the end wall panels 22, allowing access to the interior of the enclosed structure 10. Face boards 26 may be used at the corners of the structure to conceal the ends of the wall panels 20 and 22. Generally speaking, the above-described structural members of building 10 are constructed of wood. However, other materials could be used without departing from the scope of the present invention.

Figure 2:
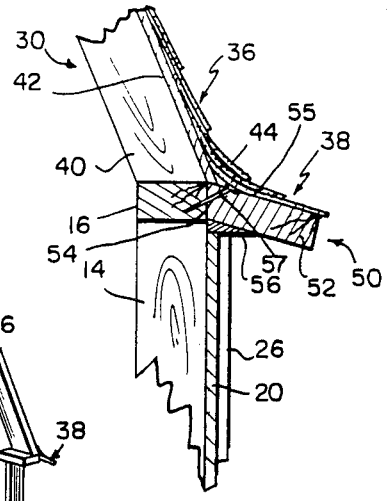
(PRIOR ART) FIG. 2
FIG. 2 is a fragmentary cross-sectional view of a building structure embodying the prior art.
Figure 3:
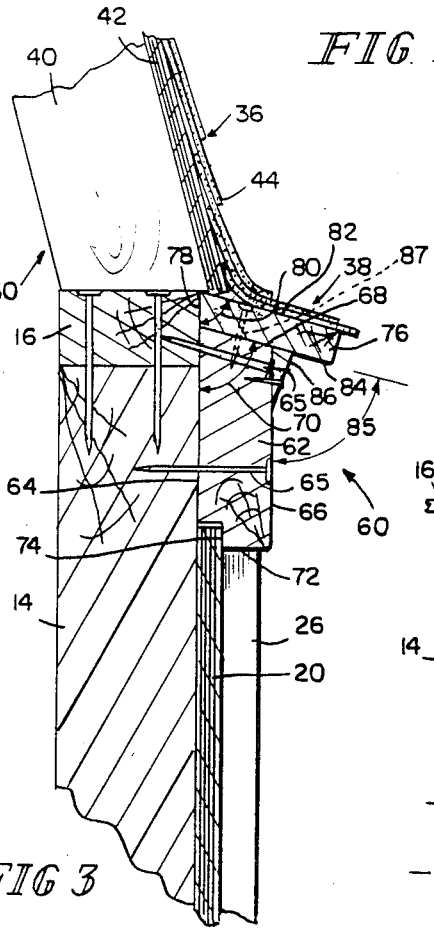
FIG. 3 is a fragmentary cross-sectional view of the building structure shown in FIG. 1, taken generally along section lines 3—3 in FIG. 1.

In the illustrative embodiment of building structure 10, the roof 30 is a curb roof having a double slope on each of its two sides. The roof 30 includes a center ridge 32, an upper section 34 having a first slope, and a lower section 36 having a second slope. In comparison, the upper section 34 has a flatter slope, and the lower section 36 has a steeper slope. As is generally the case with most roofs, roof 30 has a lower border 38 which overhangs the side wall panels 20 on the two sides of the building structure 10. This overhang is sometimes referred to as the eave of the building structure 10. The lower border 38 has a gradual slope in comparison to the slopes of the upper and lower sections 34 and 36. The roof structure includes rafters 40, decking 42 secured to the rafters 40, and shingles 44 covering the decking 42, as best shown in FIGS. 2 and 3. In the building structure 10 shown in FIG. 1, the rafters 40 may include a plurality of 2 inch by 4 inch wooden beams, and the decking may have a thickness of ½ inch. The building and type of roof are not important to the present invention since certain structural elements are common to almost all buildings, such as, for example, frame 12, walls 20 and 22, and a lower roof border 38 which overhangs side walls 20. The present invention is directed to structural features which may be adapted to various buildings having these structural elements. Thus, it is not intended that the present invention be limited to any specific building or type of roof.

Figure 4:
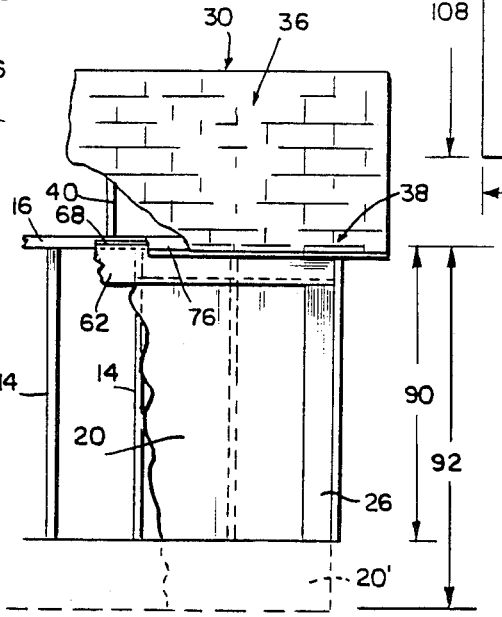
FIG. 4 is a fragmentary side elevational view, partly broken away, of the building structure shown in FIG. 1.
Figure 5:
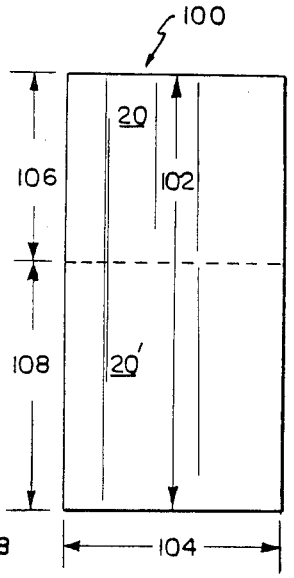
FIG. 5 is a plan view of a sheet of building material illustrating how waste is reduced by the building structure embodying the present invention.

The improved structural means 60 embodying the present invention can best be described by referring to FIGS. 3, 4, and 5. The structural means 60 includes a frame member 62 which in the preferred embodiment is an elongated 2 inch by 6 inch wooden board. The frame member 62 extends horizontally beneath the lower border 38 of the roof 30 and has an inner surface 64 which engages the vertical studs 14 and the top plate 16. The frame member 62 is secured to the studs 14 and the top plate 16 by conventional means such as nails 65. The outer surface 66 of frame member 62 forms an upper portion of the outer side wall of the building structure 10. The top edge 68 of frame member 62 is cut so that the top edge 68 surface forms an acute angle 70 with respect to the inner surface 64 of the frame member 62. The top edge 68 is located in proximity to the lower border 38 of the roof 30, and provides a support surface for the lower roof border 38 in a manner which will be explained later. The acute angle 70 may vary, depending upon the desired slope of the overhanging lower border 38.

The bottom edge 72 of the frame member 62 includes a rabbet 74 for receiving the side panel 20. As shown in FIG. 3, the rabbet 74 is cut out of the bottom edge 72 and the inner surface 64 of the frame member 62. In the preferred embodiment, rabbet 74 has dimensions of ½ inch and ⅝ inch and extends longitudinally for receiving the top edge of a panel 20 having a thickness of ⅝ inch. It can be appreciated that the dimensions of the rabbet 74 may vary, depending upon the thickness of the panel 20. Panel 20 forms the lower portion of the outer side wall of the building structure 10. Thus, as best shown in FIG. 3, the outer side wall of a building structure 10 embodying the present invention is formed by frame member 62 and panel 20. Since in the preferred embodiment, frame member 62 is a 2 inch by 6 inch wooden board, the upper 6 inches of the side wall is provided by the frame member 62.

Referring particularly to FIG. 3, a roof deck or support member 76 for the lower roof border 38 is supported on the top edge 68 of the frame member 62. In the preferred embodiment, the deck member 76 is an elongated 1 inch by 3 inch wooden board. The board 76 has an inner edge 78 which is longitudinally cut so that the inner edge 78 surface forms an acute angle 80 with the top surface 82 of the roof member 76. This angle 80 in combinati, n with angle 70 provides the slope for the lower border 38. Angle 80 is preferably equal to the acute angle 70. The bottom surface 84 of the roof member 76 engages the top edge 68 surface of the frame member 62 and is secured to the frame member 62 and top plate 16 of the frame 12 by conventional means such as nails. An acute angle 85 is formed between the outer surface 66 of a frame member 62 and the bottom surface 84 of roof member 76. Acute angle 85 is preferably equal to angles 70 and 80. In the prior art shown in FIG. 2, it was necessary to utilize a 2 inch by 6 inch board for the lower border 38 roof member 52 in order to provide a sufficient inner edge 54 for securing the member 52 to the top plate 16. The structural means 60 embodying the present invention allows the use of a smaller, lighter-weight board for the roof overhang support member 76 and provides a more stable lower roof border 38. As best shown in FIG. 3, nails 87 can be driven through the roof member 76 directly into the top edge 68 of the frame member 62, as opposed to being driven at a slant through the roof member 52 (toenailed) into the top plate 16, as shown in FIG. 2.

The elongated wedge-shaped piece cut from the top edge 68 of the frame member 62 may be secured to the outer surface 66 of the frame member 62 beneath the overhang of the roof member 76 as a decorative finishing piece. The wedge-shaped piece 86 may be secured to the outer surface 66 using conventional means such as nails.

Continuing to refer to FIG. 3, the frame member 62, in addition to forming an upper portion of the side wall of the building structure 10, also increases the strength, straightness, and stiffness of the frame 12. The frame member 62 is secured to the studs 14 transverse to their vertical orientation relative to each other. By further securing the frame member 62 to the top plate 16, wobbling of the studs 14 is reduced. The studs 14 remain straight and stiff, thereby increasing the overall strength of the frame structure 12. In a building structure 10 of the type shown in FIG. 1, the frame member 62 also provides frame structure between the studs 14 which can be used for mounting hooks, screws, or other hanging structures inside the building 10.

The structural means 60 also provides another advantage heretofore not provided by prior art structure. If a side panel 20 should be ruined or begin deteriorating, it can easily be replaced by pulling the panel 20 downward and out of the rabbet 74. Since rabbet 74 holds the upper edge of panel 20 in position, the panel 20 can be secured to the frame 12 using less nails than heretofore required. In order to remove a panel 20, it is only necessary to force the bottom edge of the panel 20 outward so that the nails no longer hold the panel 20 to the studs 14 and pull the panel 20 out of the rabbet 74.

Referring particularly to FIGS. 4 and 5, building structure 10 embodying the present invention with side walls having a height 90 of 4 feet and a height 92 of 5 feet can be constructed so that side panels 20 and 20′ can be cut from a sheet of building material with no waste. Thus, the structural means 60 provides maximum utilization of side panel 20 building materials. Since frame member 62 forms an upper 6 inch portion of the side wall, a 3½ inch panel 20 is needed to form the lower portion of a side wall having a height 90 of 4 feet, and a 4½ inch panel 20 is needed to form the lower portion of a side wall having a height 92 of 5 feet. Referring to FIG. 5, a sheet of building material 100 cut to form the panels 20 and 20′ typically has a length 102 of 8 feet and a width 104 of 4 feet. Thus, a panel 20 having a height 106 of 3½ feet and a panel 20' having a height 108 of 4½ feet can be cut from the sheet 100 of building material, leaving no waste. Using the prior art structure, as shown in FIG. 2, it would be necessary to cut a panel 20 from sheet 100 having a height of 5 feet to produce a building having a side wall of 5 feet. This would leave a portion of the sheet of material 100 having a height of 3 feet. This remaining portion of the sheet 100 could not be used because a sheet having a height of 4 feet would be needed for a building with side walls having a height of 4 feet.

Utilizing the structural means 60 embodying the present invention, a building structure 10 can be produced at a lower cost while at the same time increasing its strength and decorative features, and while further making it easier to replace side panels 20. These advantages are achieved by reducing building material waste, increasing the rigidity and strength of the framework, and eliminating the need to nail or otherwise secure the upper portion of the side panels 20 to the framework. It will also be appreciated that other advantages are also produced by the structural means 60 embodying the present invention, such as design flexibility and an additional inside frame structure between studs for hanging equipment inside the building structure 10.

Figure 6:
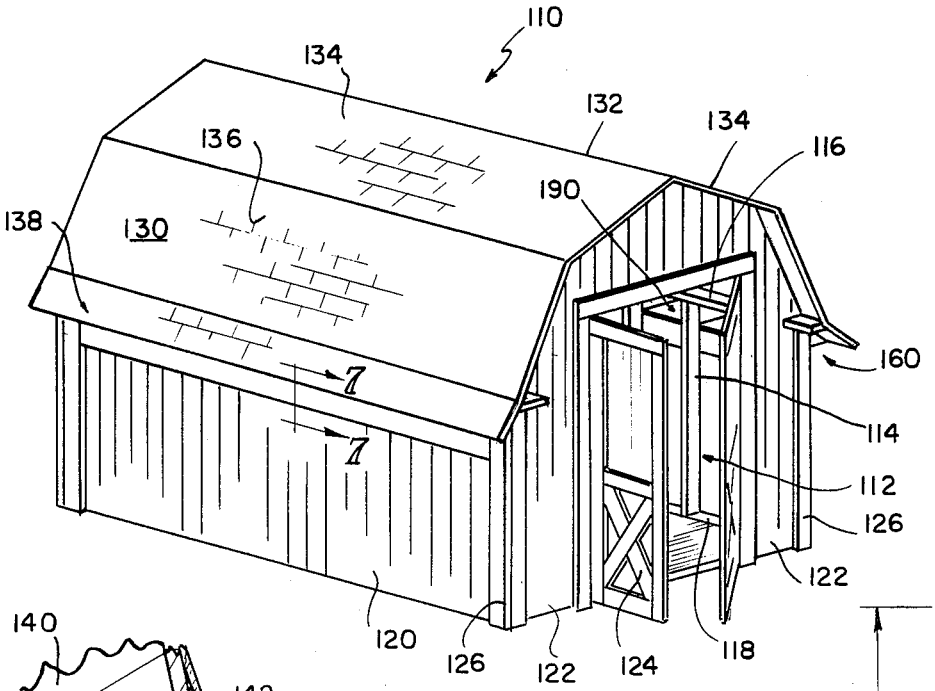
FIG. 6 is a perspective view of a building structure embodying the present invention.

Referring to FIG. 6, a second embodiment of a building structure 110 of the present invention comprises a frame 112 which includes a plurality of vertical studs 114 and horizontal top and bottom plates 116 and 118, respectively, supporting the studs 114 in spaced-apart vertical relationship. Outer side wall panels 120 and outer end walls 122 are secured to the frame 112 using nails or other conventional means, and a roof 130 is mounted on the frame 112 to enclose the structure. A door 124 is provided in one of the end wall panels 122, allowing access to the interior of the enclosed structure 110. Face boards 126 may be used at the corners of the structure to conceal the ends of the wall panels 120 and 122. Generally speaking, the above-described structural members of building 110 are constructed of wood. However, other materials could be used without departing from the scope of the present invention.

Figure 7:
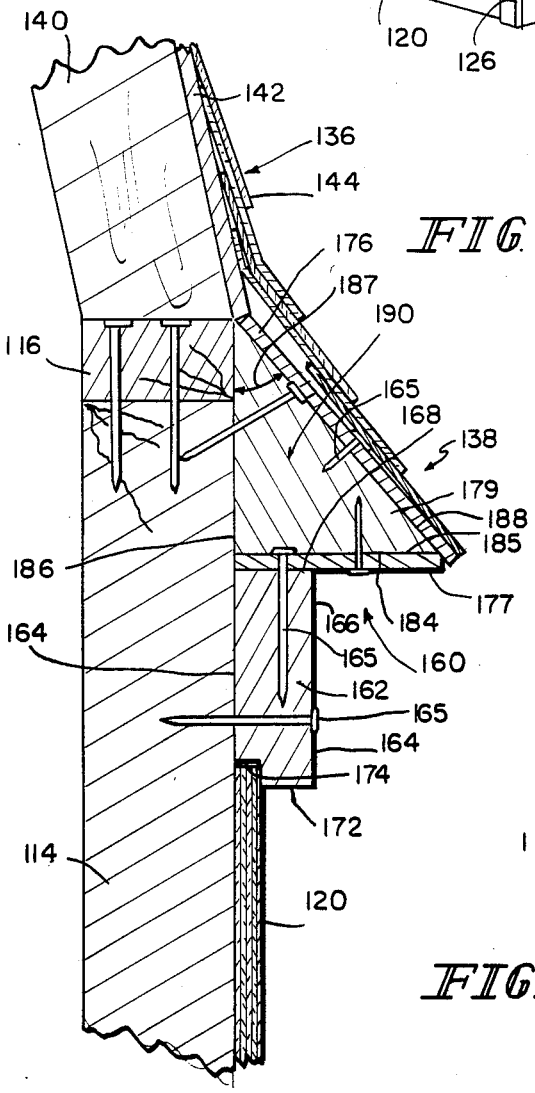
FIG. 7 is a fragmentary cross-sectional view of the building structure shown in FIG. 6 taken generally along section lines 7—7 in FIG. 6.

In the illustrative embodiment of building structure 110, the roof 130 is a curb roof having a double slope on each of its two sides. The roof 130 includes a center ridge 132, an upper section 134, having a first slope, and a lower section 136 having a second slope. In comparison, the upper section 134 has a flatter slope, and the lower section 136 has a steeper slope. As is generally the case with most roofs, roof 130 has a lower border 138 that overhangs side wall panels 120 on the two sides of the building structure 110. This overhang is sometimes referred to as the eave of the building structure 110. The lower border 138 has a gradual slope in comparison to the slopes of the upper and lower sections 134 and 136. The roof structure includes rafters 140, decking 142 secured to the rafters 140, and shingles 144 covering the decking 142, as best shown in FIG. 7. In the building structure 110 shown in FIG. 6 the rafters 140 may include a plurality of 2 inch ×4 inch wooden beams, and the decking may have a thickness of ½ inch. The building and type of roof are not important to the present invention since certain structural elements are common to almost all buildings, such as, for example, frame 112, walls 120 and 122, and lower roof board 138 which overhangs side walls 120. The present invention is directed to structural features which may be adapted to various buildings having these structural elements. Thus, it is not intended that the present invention be limited to a specific building or type of roof.

Figure 9:
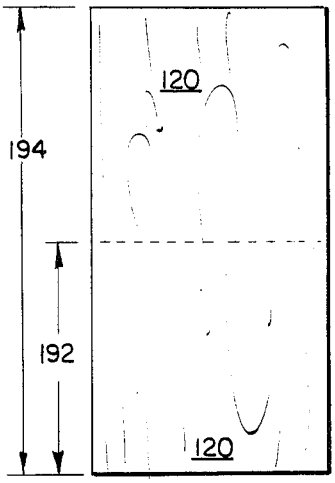
Figure 8:
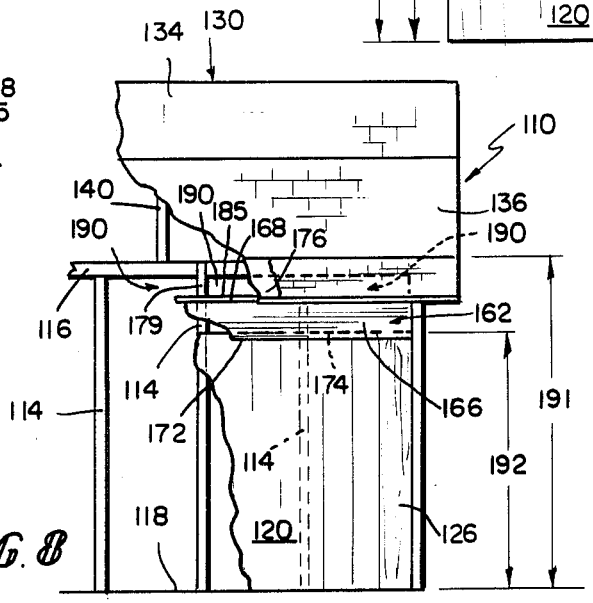
FIG. 8 is a fragmentary side elevational view partly broken away, of the building structure shown in FIG. 7; and, FIG. 9 is a plan view of a sheet of building material illustrating how waste is reduced by the building structure embodying the present invention.

The improved structural means 160 embodying the present invention can best be described by referring to FIGS. 7, 8, and 9. Structural means 160 includes a frame member 162 which in the preferred embodiment is an elongated 2 inch ×6 inch wooden board. Frame member 162 extends horizontally beneath the lower border 138 of the roof 130 and has an inner surface 164 which engages the vertical studs 114. The frame member 162 is secured to the studs 114 by conventional means, such as nails 165. The outer surface 166 of frame member 162 forms an upper portion of the outer side wall of the building structure 110. The top edge 168 of the frame member 162 is cut so that the top edge 168 is perpendicular with respect to the inner surface 164 of the frame member 162. The top edge 168 is located below the lower border 138 of the roof 130 and provides a support surface for the lower roof border 138 in a manner which will be explained later.

The bottom edge 172 of the frame member 162 includes a rabbet 174 for receiving the side panel 120. As shown in FIG. 7, the rabbet 174 is cut out of the bottom edge 172 and the inner surface 164 of the frame member 162. In the preferred embodiment, rabbet 174 has dimensions of ½ inch and ⅝ inch and extends longitudinally for receiving the top edge of panel 120 having a thickness of ½ inch. It can be appreciated that the dimensions of the rabbet 174 may vary, dependent upon the thickness of the panel 120. The panel 120 forms the lower portion of the outer side wall of the building structure 110. Thus, as best shown in FIG. 8, the outer side wall of the building structure 110 embodying the present invention is formed by frame member 162 and panel 120. Since in the preferred embodiment frame member 162 is a 2 inch ×6 inch wooden board, the upper 6 inches of the side wall is provided by frame member 162.

Referring particularly to FIG. 8, a roof deck or support member 176 for the lower roof border 138 is attached to a plurality of spacer members 179. Spacer members 179 are supported on the top edge 168 of the frame member 162 and uniformly spaced apart adjacent each vertical stud 114. In the illustrative embodiment, a shelf member 177 or soffit is positioned between the top edge 168 of the frame member and the spacer member 179 such that it extends perpendicular to the vertical studs 114. The shelf member or soffit 177 is secured to frame member 162 by any conventional means, such as nails 165. The roof support member 176 is attached to the spacer members 179 by any conventional means such as nails 165.

Each spacer member 179 is generally right triangular shaped in side elevation and is formed by cutting an elongated 2 inch ×6 inch wooden board at an angle of 45°. Each spacer member 179 has a bottom surface 182 and a side surface 186 at an angle of 90° with respect to the bottom surface 182. Both the bottom surface 182 and side surface 186 have a length of generally 5½ inches to 6 inches. The hypotenuse of each spacer member 179 provides a surface 186 for attaching the support member 176 thereto. The bottom surface 184 of each spacer member 179 is seated on the top surface 185 of shelf member or soffit 177. The side surface 186 of each spacer member 179 is secured to a vertical stud 114 of frame 112 by conventional means, such as nails. In this manner, the side surface 186 of each spacer member 179 forms an upper portion of the frame to add strength and rigidity to the overall structure. A 45° angle 187 is formed between the side surface 186 and the top surface 188. This angle 187 provides the slope for the lower border 138.

Continuing to refer to FIG. 8, the frame member 162 in addition to forming an upper portion of the side wall of the building structure 110 also increases the strength, straightness, and stiffness of the frame 112. The frame member 162 is secured to the studs 114 transverse to their vertical orientation relative to each other. By further securing the soffit 177 and spacer members 179 to frame member 162 and the studs 119, wobbling of the studs 114 is reduced. The studs 114 remain straight and stiff, thereby increasing the overall strength of the frame structure 112. In a bulding structure 110 of the type shown in FIG. 6, the frame member 162 also provides frame structure between the studs 114 which can be used for mounting hooks, screws, or other hanging structures inside the building 110. Additionally, the space defined between the studs 114 by the spacer members 179 and the soffit 177 can be used as shelves 190 (as shown in FIG. 6). This is extrememly useful when an individual wishes to maximize the use of available storage space, as sufficient shelf space is provided for hammers and various other tools without the need for mounting shelves within the interior of the frame structure.

The structural means 160 shown in FIGS. 6–9 also provides other advantages heretofore not provided by prior art structures. If a side panel 120 should be ruined or begin deteriorating, it can easily be replaced by pulling the panel 120 downward and out of the rabbet 174. Since rabbet 174 holds the upper edge of panel 120 in position, the panel can be secured to the frame 112 using less nails then heretofore required. In order to remove the panel 120, it is only necessary to force the bottom edge of the panel 120 outward so that the nails no longer hold the panel 120 to the studs 114 and pull the panel 120 out of the rabbet 174.

Referring particularly to FIGS. 8 and 9, building structures 110 embodying the present invention with interior side walls having a height 191 of approximately 5 feet and a height of approximately 9 feet (not shown) can be constructed so that side panels 120 having a height of 4 feet (192) and 8 feet (194), respectively, can be used from a sheet of building material with no waste. The increase in the height of the interior side walls is provided without any increase in the overall height of the building structure with outer side walls having heights of $4\frac{1}{2}$ feet and $8\frac{1}{2}$ feet. Thus, the structural means 160 provides maximum utilization of side panel 120 building materials. Frame member 162 forms an upper $5\frac{1}{2}$ inches to 6 inches on the outer side wall of the building 110. The soffit 177 and spacer member 176 in combination provide an additional $5\frac{1}{2}$ inches to 6 inches to the interior side wall. Referring to FIG. 8, a sheet of building material cut to form the panels 120 typically has a length 194 of 8 feet and a width of 4 feet. Thus, a 4 foot (192) panel 120 can be used to form the lower portion of the side wall having an interior height 191 of approximately 5 feet and two 4 foot (194) panels 120 can be used to form the lower portion of the side wall having an interior height (not shown) of 9 feet. Thus, conventional panels of 4 feet×4 feet (as shown in FIG. 9) can be utilized to form the side walls 120 having a greater interior height 191 without waste and no additional cutting operation.

Utilizing the structural means 160 embodying the present invention, a building structure 110 having a greater interior side wall height can be produced at a lower cost while at the same time increasing its strength and decorative features, and while further making it easier to replace side panels 120. These advantages are achieved by reducing building material waste, increasing the rigidity and strength of the framework, and eliminating the need to nail or otherwise secure the upper portion of the side panels 120 to the framework. It will also be appreciated that other advantages are also produced by the structural means 160 embodying the present invention, such as design flexibility and an additional inside frame structure and shelving between studs for hanging equipment inside the building structure 110.

What is claimed is:

1. A building structure, comprising outer walls, a roof including a lower border that overhangs at least one of the out walls, a frame for supporting the outer walls and roof, the frame including a frame member forming part of an upper portion of the one outer wall, the frame member having a top edge adjacent the roof and a bottom edge, a wall panel secured to the frame adjacent the bottom edge of the frame member, the wall panel forming the lower portion of the one outer wall, at least one spacer member supported on the top edge of the frame member for providing a lower border rafter extending substantially beyond and substantially below the top edge of said frame, the spacer member having a side surface forming an upper portion of the frame and a top surface at an acute angle with respect to the side surface, and roof member transverse to said spacer member and supported on the top surface of the spacer member to provide the lower border of the roof.

2. The building structure of claim 1 wherein the spacer member is generally right triangular shaped in side elevation and includes a bottom surface at a right angle to the side surface.

3. The building structure of claim 2 further comprising a shelf member positioned between the top edge of the frame member and the bottom surface of the spacer member.

4. The building structure of claim 3 further comprising a rabbet in the bottom edge of the frame member for receiving a top edge of the wall panel.

5. The building structure of claim 4 wherein the frame further includes a plurality of spaced-apart vertical studs and at least one top plate secured to the top of the studs, the frame member being secured to the studs transverse to the vertical plane of the studs to provide strength and rigidity of the frame.

6. The building structure of claim 5 wherein the shelf member extends perpendicular to the vertical studs.

7. The building structure of claim 6 further comprising a plurality of spacer members uniformly spaced apart, each spacer member being supported on the top edge of the frame member adjacent and attached to each vertical stud to provide strength and rigidity to the frame.

8. The building structure of claim 7 wherein the roof support member is secured to the top surface of each spacer member.

9. The building structure of claim 1 wherein the one outer wall has an outer surface having a predetermined height, the frame member has an outer surface having a predetermined width, and the wall panel has a height generally equal to the predetermined height of the outer surface of the one outer wall less the predetermined width of the outer surface of the frame member.

10. The building structure of claim 9 wherein the side surface of the spacer member has a predetermined height and the one outer wall has an interior height generally equal the predetermined height of the panel plus the predetermined width of the frame member plus the predetermined height of the side surface of the frame member.

11. The building structure of claim 1 wherein said frame includes a plurality of spaced apart vertical studs and means for securing the frame member to said studs to provide strength and rigidity to the frame.

12. The building structure of claim 11 further comprising a plurality of spacer members uniformly spaced apart, each spacer member being supported on the top edge of the frame member adjacent and attached to each vertical stud to provide strength and rigidity to the frame.

13. The building structure of claim 1 wherein said spacer member is a unitary element.

* * * * *

UNITED STATES PATENT AND TRADEMARK OFFICE

CERTIFICATE OF CORRECTION

PATENT NO. : 4,573,293

DATED : March 4, 1986

INVENTOR(S) : Owen H. Park

It is certified that error appears in the above-identified patent and that said Letters Patent is hereby corrected as shown below:

Column 4, line 1, change "combinati,n" to --combination--.

Column 6, line 29, change "1/2" to --5/8--.

Column 7, line 16, change "bulding" to --building--.

Column 7, line 23, change "extrememly" to --extremely--.

Column 8, line 19 (claim 1), change "out" to --outer--.

Signed and Sealed this

*First* Day of *July 1986*

[SEAL]

*Attest:*

DONALD J. QUIGG

*Attesting Officer*

*Commissioner of Patents and Trademarks*